US008295529B2

(12) United States Patent
Petersen et al.

(10) Patent No.: US 8,295,529 B2
(45) Date of Patent: Oct. 23, 2012

(54) GAMING HEADSET WITH INTEGRATED MICROPHONE AND ADAPTED FOR OLFACTORY STIMULATION

(75) Inventors: Ryan M. Petersen, Sunnyvale, CA (US); Franz Michael Schuette, Colorado Springs, CO (US)

(73) Assignee: BCInet, Inc., San Jose, CA (US)

( * ) Notice: Subject to any disclaimer, the term of this patent is extended or adjusted under 35 U.S.C. 154(b) by 1366 days.

(21) Appl. No.: 11/845,896

(22) Filed: Aug. 28, 2007

(65) Prior Publication Data

US 2008/0049960 A1 Feb. 28, 2008

Related U.S. Application Data

(60) Provisional application No. 60/823,706, filed on Aug. 28, 2006.

(51) Int. Cl.
*H04R 25/00* (2006.01)

(52) U.S. Cl. ..... 381/374; 381/371; 381/375

(58) Field of Classification Search ..... 381/370, 381/371, 374, 375, 376, 382, 384; 379/430; 181/128, 129; 128/200.28, 201.19, 201.24, 128/204.18, 206.12
See application file for complete search history.

(56) References Cited

U.S. PATENT DOCUMENTS

| | | | | |
|---|---|---|---|---|
| 5,381,486 | A * | 1/1995 | Ludeke et al. | 381/375 |
| 5,610,674 | A | 3/1997 | Martin | |
| 5,697,363 | A * | 12/1997 | Hart | 128/201.24 |
| 6,149,873 | A | 11/2000 | Potter et al. | |
| 6,169,595 | B1 | 1/2001 | Manne | |
| 6,247,470 | B1 * | 6/2001 | Ketchedjian | 128/200.28 |
| 6,295,366 | B1 * | 9/2001 | Haller et al. | 381/374 |
| 6,702,767 | B1 | 3/2004 | Douglas et al. | |
| 6,803,987 | B2 | 10/2004 | Manne | |
| 6,994,328 | B2 | 2/2006 | Watkins et al. | |
| 7,694,680 | B2 * | 4/2010 | Brichetto | 128/206.12 |
| 2001/0017925 | A1 * | 8/2001 | Ceravolo | 381/370 |

* cited by examiner

*Primary Examiner* — Huyen D Le
(74) *Attorney, Agent, or Firm* — Hartman Global IP Law; Gary M. Hartman; Domenica N. S. Hartman

(57) ABSTRACT

A gaming headset adapted for precise delivery of chemical substances capable of olfactory stimulation, such as odorants, fragrances, pheromones, etc. The headset includes at least one earpiece containing a speaker, a feature for securing the earpiece to the person's head while positioning the speaker over one of the person's ears when the headset is worn, an armature disposed relative to the earpiece so as to extend toward the person's mouth, a microphone located on the armature so as to be located in front of the person's mouth, and a feature supported by and extending along the armature for delivering at least one chemical substance to the person's nostril's when the headset is worn.

16 Claims, 1 Drawing Sheet

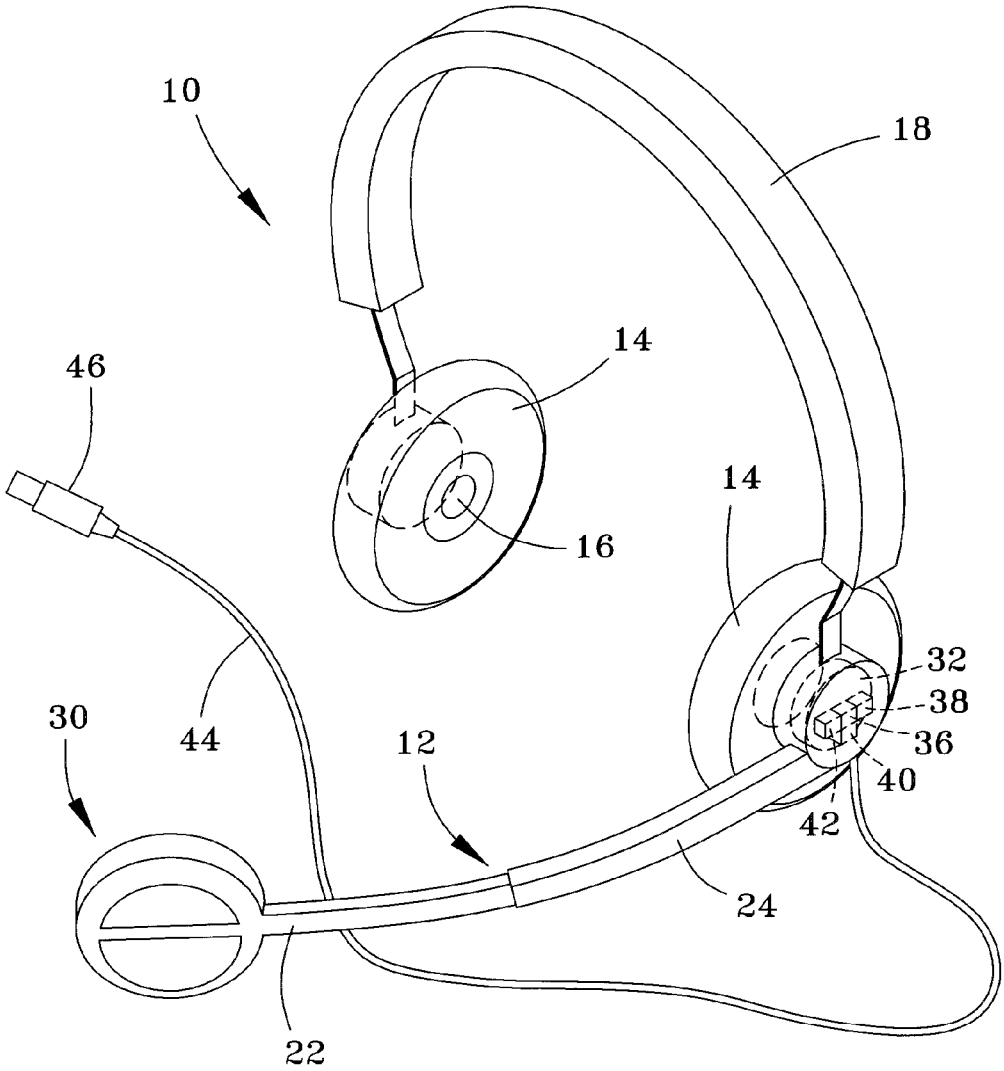
FIG.1
FIG.2
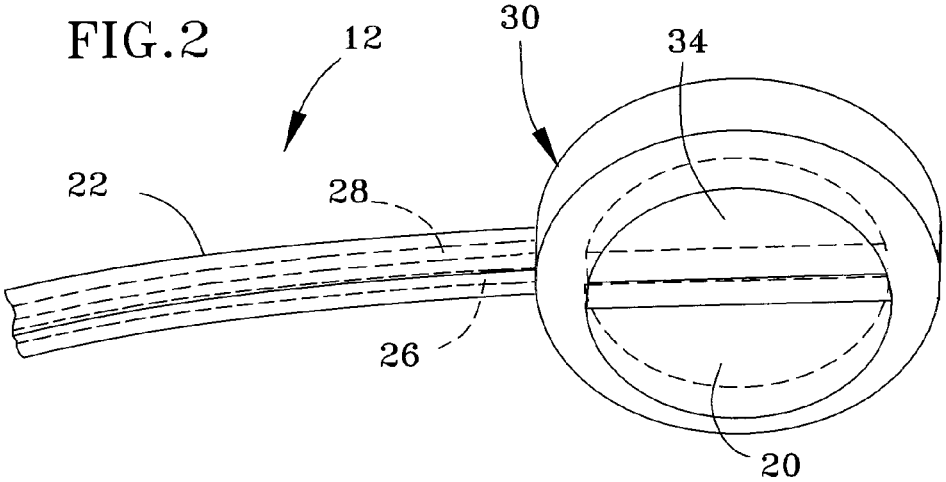

GAMING HEADSET WITH INTEGRATED MICROPHONE AND ADAPTED FOR OLFACTORY STIMULATION

CROSS REFERENCE TO RELATED APPLICATIONS

This application claims the benefit of U.S. Provisional Application No. 60/823,706, filed Aug. 28, 2006, the contents of which are incorporated herein by reference.

BACKGROUND OF THE INVENTION

The present invention generally relates to gaming systems and peripheral devices therefor. More particularly, this invention relates to a headset adapted for use with a gaming system and configured to provide an olfactory stimulation capability.

The experience of virtual reality in computer-based gaming systems depends on the effective representation of sensory modalities. Of the five sensory modalities (sight, hearing, touch, smell, and taste) only two—sight and hearing—are typically addressed in most gaming setups through visual and auditory inputs in the form of a screen display and sound output to speakers or headphones. Smell and taste are absent from most gaming scenarios, and tactile information is generally limited to virtual reality configurations. One multisensory stimulation system incorporating tactile and olfactory stimulation has been described in U.S. Pat. No. 6,702,767 to Douglas et al.

Current gaming setups often employ headsets instead of speaker setups. The advantages of headsets compared to, for example. a surround sound speaker setup, are that there is little or no disturbance of others. Likewise, the cost of a headset is in most cases substantially lower than that of a speaker system of comparable audio quality. Surround sound headphones such as the Zalman Theatre6 six-speaker headphones are generally preferred to simple stereo headphones because they generate better positional audio cues that translate into better survival chances in first-person shooter games. However, a drawback of most headphones is the suppression of background noise, either because of the adaptation to the sound levels of the headphones in "open" headphones or simply because of the shielding or noise suppression accomplished by "closed" headphone designs. On the other hand, unlike the situation of competitive gaming, casual virtual combat or even practice battles do not require complete separation from the environment. Instead, it is often desirable to maintain a certain degree of contact with the outside world. Gaming headphones, therefore, sometimes incorporate additional inputs, for example, for phone or intercom systems that are blended into the audio stream. At the same time, it is possible to port a microphone to the headphones to use the gaming headphones as a headset. Such headsets can be utilized for telephony as well as for communicating messages to opponents in games that are ported to support this option. The positioning of the microphone can either be lateral to the head or, as in aviation headsets, directly in front of the mouth.

Of increasing interest to the gaming industry is the use of olfactory stimuli, that is, the use of smells to create an ultimate gaming sensation. The importance of smell can be appreciated by the fact that the olfactory system is the phylogenetically oldest sensory system, and as such harbors the triggering of primal instincts and emotional reactions beyond anything accomplishable with visual or auditory stimuli. Even though those olfactory stimuli are important, the complexity of the olfactory system and a profound lack of its understanding have been barriers to the commercial realization of a synthetic smell delivery apparatus. Only very recently has some progress has been made, based on the identification and functional classification of four distinct classes of olfactory receptors and some limited understanding of smell decoding.

A fundamental difference between the olfactory and taste systems on one side and the other sensory modalities is that the latter recognize energy in its different manifestations. Hearing uses pressure waves, vision uses light, tactile sensation uses temperature and/or mechanical force. In contrast, taste and smell both entail the recognition of chemical substances within the environment that are binding to either taste buds or olfactory receptors, and possibly the vomeronasal organ (VNO, or Jacobson's organ). Even more complex and less understood is the issue of pheromones, that is, airborne hormones that do not evoke a smell sensation but trigger other physiological responses like arousal, attraction or, on the other end of the scale, deep enmity.

Because the sensation of smell requires the presence of odors in the form of chemical substances that must be inhaled to bind to receptors within the olfactory epithelium of the nasal mucosa, such substances require a mechanism for their release into the air. The amount of air going through the nasal passages is only a minor fraction of the total air volume in the environment of the person playing computer games (from hereon referred to as the "gamer"). Consequently, the amount of odorants or pheromones released into the environment must be large enough so that even the small fraction reaching the nasal receptors will evoke a sensation. In other words, the total amount of odorants needed in any given environment is orders of magnitude higher than that which will eventually reach the targeted olfactory receptors.

Related to the mismatch between total release of odor molecules and those molecules actually smelled is the problem that, even if it is possible to construct an apparatus that generates different odors by mixing known basic ingredients, those components, once released, will linger in the environment until a complete exchange of air has taken place. In other words, when changing a scene in a computer game, the scents from the previous scene will remain if they are released into the environment in a more or less nonspecific way. The consequent mixing of different aromas can create some very confusing and undesirable effects that are preferably avoided. Often, it is in the interest of the gamer that nobody else in his or her environment will be subjected to potentially foul odors, pheromones, or other chemical substances intended exclusively for the gamer's gaming experience.

Several approaches have been suggested in the computer gaming industry to incorporate smells into a multimodal virtual reality sensation. "ismell," a computer peripheral device developed by DigiScents, Inc., is based on air diffusers that create an aerosol by mixing a number of different aromatic substances to create synthetic odors. The odors are blown in relatively small quantities toward the gamer using a fan. In the interest of keeping contamination of the environment and use of potentially costly supplies as low as possible, the odors were kept at minimal levels, barely reaching the threshold of an olfactory sensation. From a practical standpoint, it is clear that this approach has several drawbacks, particularly the inefficient delivery of the odors to overcome sub-threshold levels, the consequent waste of substances, and contamination of the environment. Moreover, the olfactory system is extremely adaptive and, thus, a slow increase in concentration of any substance may push the recognition threshold to require even higher concentrations of odorants. As a result, different solutions have been sought to overcome these limitations.

More recently, a number of smell generators have been introduced, creating aerosols that are blown in the general direction of the recipient. One such device proposed as an olfactory computer game enhancement is described in U.S. Pat. No. 6,149,873 to Potter et al. In this particular case, as well as in most other cases, a number of substances are mixed in specific ratios to create synthetic odors for the purpose of triggering certain olfactory responses. However, a drawback is the nonspecific release of smells into the environment, which adds cost and risks unpleasant side effects on others sharing the same environment. U.S. Pat. No. 6,994,328 to Watkins et al. is intended to address this concern with the use of a bolus generator that blows scented "smoke rings" of highly concentrated scents at a target. Other approaches are described in U.S. Pat. Nos. 6,169,595 and 6,803,987 to Manne and involve delivering scents to a gamer through a nasal tube, a mask, or a stand, and then using a scent scrubber to clear lingering odors before a new scent is delivered. Another precision scent-delivery system using a nasal tube is disclosed in U.S. Pat. No. 5,610,674 to Martin.

BRIEF SUMMARY OF THE INVENTION

The present invention provides an apparatus for precise delivery of chemical substances capable of olfactory stimulation, such as odorants, fragrances, pheromones, etc., through an unconventional use of a device that is otherwise common in current high-end gaming configurations, namely a headset with an integrated microphone.

The headset includes at least one earpiece containing a speaker, a feature for securing the earpiece to the person's head while positioning the speaker over one of the person's ears when the headset is worn, an armature disposed relative to the earpiece so as to extend toward the person's mouth when the headset is worn, a microphone located on the armature so as to be located in front of the person's mouth when the headset is worn, and a feature supported by and extending along the armature for delivering at least one chemical substance to the person's nostril's when the headset is worn.

In view of the above, it can be seen that a significant advantage of this invention is that the armature of the headset on which the microphone is mounted is used as a conduit capable of precise delivery of chemical substances for olfactory stimulation (as well as any other chemicals potentially of interest). When positioned by the headset in front of the mouth of a gamer, as is conventionally done for headset microphones, the microphone armature provides a conduit capable of precisely delivering very targeted releases of chemical substances near the nose of the gamer, and by equipping the armature with a suitable orifice through which the chemical substances are discharged, the substances can be directed directly toward or even into the nose of the gamer. Consequently, the escape of odors into the environment can be extremely limited compared to other approaches that generally release an odor or fragrance into the environment of the gamer. As such, the present invention provides an uncomplicated implementation capable of providing a superior gaming and sensual experience through multimodal sensory integration (sight, hearing, and smell) by enabling limited and very localized deliveries of chemical substances directed toward a gamer's nose, thereby achieving rapid changes in the smell environment while minimizing environmental contamination and the cost of restocking the chemical substances.

Other objects and advantages of this invention will be better appreciated from the following detailed description.

BRIEF DESCRIPTION OF THE DRAWINGS

FIG. 1 is a perspective view of a headset having a microphone armature adapted for delivering chemical substances to the nose of a person wearing the headset in accordance with an embodiment of this invention.

FIG. 2 represents a detailed rear view of a distal end of the microphone armature of FIG. 1.

DETAILED DESCRIPTION OF THE INVENTION

FIGS. 1 and 2 depict a headset 10 with a microphone armature 12 adapted to deliver chemical substances to the nostrils of a person wearing the headset 10. Aside from this capability, the headset 10 can generally have a conventional configuration and construction, as well as an unconventional configuration and construction, and as such the headset 10 represented in the Figures is merely for illustrative purposes.

As seen in the Figures, the headset 10 includes earpieces 14, each preferably (though not necessarily) equipped with a speaker 16. The earpieces 14 are shown as interconnected by a bridge 18 conventionally configured to locate the earpieces 14 on opposite sides of the wearer's head and over the wearer's ears. As is also conventional, the microphone armature 12 carries a microphone 20 at or near its distal end 30. The armature 12 is shown as extending from one of the earpieces 14, and is configured to locate the microphone 20 in front of the wearer's mouth when the headset 10 is worn. For example, and as well known in the art, the length of the armature 12 is represented in FIG. 1 as being adjustable as a result of constructing the armature 12 to comprise a bracket 22 slidably received in a sleeve 24. If so desired, the angular orientation of the armature 12 may also be made adjustable by pivotally connecting the armature 12 to the earpiece 14. As is usual, wiring 26 within the armature 12 carries electrical signals generated by the microphone 20 to the headset 10, and a cable 44 carries the electrical signals to a computer or other gaming system (not shown), which may then use the signals for audible communications with others or audible inputs to the gaming system. As would be expected, the cable 44 also carries electrical signals from the gaming system to the speakers 16, where the signals are converted by the speakers 16 into sounds that can be heard by the wearer. The cable 44 is preferably adapted to connect the headset 10 to the gaming system, such as with a USB plug 46 or other suitable connector.

For the purpose of delivering the chemical substances to the wearer of the headset 10, the armature 12 also contains at least one duct 28 through which the chemical substances flow from a reservoir 32, represented in FIG. 2 as being within the earpiece 14 to which the armature 12 is attached. The duct 28 delivers the chemical substances to a release orifice 34 located within the distal end 30 of the armature 12, preferably adjacent and directly above the microphone 20 as shown in FIG. 2 so that the chemical substances ejected from the orifice 34 can be more directly routed to the nostrils of the wearer, and therefore do not travel across the path between the wearer's mouth and the microphone 20. In order to facilitate rapid changes between smells, it is advantageous to minimize the diameter and length of the duct 28 between the reservoir 32 and the orifice 34. Furthermore, the orifice 34 can be configured to eject one or more very fine streams of the chemical substances, though broader distributions of the chemical substances are also foreseeable and possible.

While the reservoir 32 is represented as being housed in the earphone 14, other locations are possible including the earphone bridge 18. The reservoir 32 preferably has compartments capable of containing multiple chemical substance to allow for the mixing of multiple chemical substances as may be necessary to produce a desired smell or otherwise achieve a desired olfactory-based reaction from the headset wearer.

Because very small amounts of the chemical substances are preferably effective in the preferred embodiment, the reservoir 32 can be very small and mixing can be performed with one or more very small micro-mechanical mixing devices 38, such as a MEMS (micro-electromechanical system) device that may be powered by a battery or with electrical power delivered through the cable 44. Various chemical substances, known and developed in the future, can be used in the practice of this invention, including various odorants, fragrances, pheromones, etc., both organic and synthetic, that are capable of achieving a desired olfactory stimulation.

The release orifice 34 is shown in a preferred location above the microphone 20 at the upper surface of the distal end 30 of the armature 12, so that the chemical substances are discharged toward the nose of the headset wearer, and more preferably toward and even into the wearer's nostrils. The size and shape of the orifice 34 shown in FIG. 2 are for illustrative purposes only, in that a wide variety of orifices could be employed. The reservoir 32 can be slightly pressurized to promote the flow of the chemical substances to the orifice 34. For example, the reservoir 32 and/or its internal compartments can be pressurized by a suitable pressure source 36, such as a small cartridge of pressurized air that acts upon the exterior of the reservoir 32 or injects air into the interior of the reservoir 32. In addition or alternatively, the pressure source 36 can deliver puffs of air through the duct 28 or through a separate duct (not shown) to assist in delivering the chemical substances, resulting in the wearer being subjected to a mixture of air and one or more chemical substances. With this approach, a solenoid (not shown) can be used to intermittently release air from the pressure source 36 into a mixing chamber 40 located downstream of the reservoir 32 and its mixing device 38, as schematically represented in FIG. 1, so that mixing of the chemical substances and air at least initially occurs within the confines of the mixing chamber 40. Those skilled in the art will appreciate that the function of providing intermittent doses or a continuous stream of air capable of assisting in the delivery and possibly mixing with the chemical substances can also be performed by a pressure source 36 other than a cartridge, for example, the pressure source 36 could be a small fan integrated into the headset 10.

If mixing of the chemical substances and air is desired, a water reservoir 42 can be integrated into the headset 10 from which water vapor is drawn to moisturize the air from the pressure source 36. Alternatively or in addition, water can be used to mimic smells associated with rain or water. For example, wet asphalt smells could be used for car racing games and games that simulate a dungeon or tropical rain. Furthermore, chemical substances such as tertiary amines could be combined with the water to create an ocean breeze for simulating environments of fishing games and naval battles. In another example, chemical substances such as pheromones can be released to reinforce games with sexual content.

While the invention has been described in terms of a specific embodiment, it is apparent that other forms could be adopted by one skilled in the art. For example, the physical configuration of the headset 10 could differ from that shown, and functionally-equivalent devices could be used to achieve the desired functions of, for example, the duct 28, reservoir 32, orifice 34, pressure source 36, mixing device 38, mixing chamber 40, etc. Therefore, the scope of the invention is to be limited only by the following claims.

The invention claimed is:

1. A headset adapted to be worn by a person, the headset comprising:

at least one earpiece containing a speaker;

means for securing the earpiece to the person's head while positioning the speaker over one of the person's ears when the headset is worn;

an armature disposed relative to the earpiece so as to extend toward the person's mouth when the headset is worn;

a microphone located on the armature so as to be located in front of the person's mouth when the headset is worn;

means supported by and extending along the armature for delivering at least one chemical substance to the person's nostril's when the headset is worn;

a reservoir housed within the earpiece, storing the chemical substances, and enabling the chemical substances to be drawn therefrom and flow through the substance delivering means; and means for mixing the chemical substances after being drawn from the reservoir, the mixing means comprising a MEMS device.

2. The headset according to claim 1, wherein the armature is attached to the earpiece.

3. The headset according to claim 1, wherein the substance delivering means comprises a duct located within the armature and extending to a distal end of the armature.

4. The headset according to claim 1, wherein the substance delivering means comprises an orifice located at a distal end of the armature.

5. The headset according to claim 1, wherein the substance delivering means comprises an orifice located above the microphone when the headset is worn so as to directly release the chemical substances toward the person's nostrils.

6. The headset according to claim 1, further comprising means for delivering air simultaneously with the chemical substances through the substance delivering means.

7. The headset according to claim 6, wherein the air delivering means is integrated into the headset.

8. The headset according to claim 6, wherein the air delivering means is within the earpiece.

9. The headset according to claim 6, further comprising a mixing chamber adapted to receive the chemical substances from the reservoir and the air from the air delivering means and deliver a mixture of the chemical substances and the air to the substance delivering means.

10. The headset according to claim 6, further comprising means for delivering water simultaneously with the chemical substances and the air through the substance delivering means.

11. The headset according to claim 6, further comprising means for electrically connecting the headset to a computer gaming system.

12. A headset adapted to be worn by a person and electrically connectable to a computer gaming system, the headset comprising:

at least one earpiece containing a speaker;

means for securing the earpiece to the person's head while positioning the speaker over one of the person's ears when the headset is worn;

an armature disposed relative to the earpiece so as to extend toward the person's mouth when the headset is worn;

a microphone located on the armature so as to be located in front of the person's mouth when the headset is worn;

means for electrically connecting the speaker and the microphone to the computer gaming system;

an orifice located above the microphone on the armature when the headset is worn; and a duct within and extending along the armature for delivering at least one chemical substance to the orifice so as to directly release the chemical substances toward the person's nostril's when the headset is worn;

a reservoir adapted to store the chemical substances and from which the chemical substances are drawn and flow through the duct and the orifice; and means for mixing the chemical substances after being drawn from the reservoir and before flowing through the duct and the orifice.

13. The headset according to claim 12, wherein the microphone and the orifice are located at a distal end of the armature.

14. The headset according to claim 12, wherein the mixing means comprises a MEMS device.

15. The headset according to claim 12, further comprising means for delivering air simultaneously with the chemical substances through the duct and the orifice.

16. The headset according to claim 12, further comprising means for delivering water simultaneously with the chemical substances through the substance delivering means.

* * * * *